US010151081B2

(12) United States Patent
Kuroshita et al.

(10) Patent No.: US 10,151,081 B2
(45) Date of Patent: Dec. 11, 2018

(54) WORK VEHICLE

(71) Applicant: Kubota Corporation, Osaka-shi (JP)

(72) Inventors: Yoshihiko Kuroshita, Sakai (JP); Masahiro Sugioka, Sakai (JP); Daisuke Hashimoto, Sakai (JP)

(73) Assignee: Kubota Corporation, Osaka (JP)

( * ) Notice: Subject to any disclaimer, the term of this patent is extended or adjusted under 35 U.S.C. 154(b) by 204 days.

(21) Appl. No.: 15/163,935

(22) Filed: May 25, 2016

(65) Prior Publication Data

US 2017/0016209 A1 Jan. 19, 2017

(30) Foreign Application Priority Data

Jul. 16, 2015 (JP) ..... 2015-142179

(51) Int. Cl.

| | |
|---|---|
| ***E02F 9/22*** | (2006.01) |
| ***E02F 3/96*** | (2006.01) |
| ***E02F 9/16*** | (2006.01) |
| ***E02F 9/20*** | (2006.01) |
| *E02F 3/32* | (2006.01) |
| *E02F 3/34* | (2006.01) |

(52) U.S. Cl.

CPC ..... *E02F 9/2253* (2013.01); *E02F 3/961* (2013.01); *E02F 9/166* (2013.01); *E02F 9/2004* (2013.01); *E02F 3/32* (2013.01); *E02F 3/34* (2013.01)

(58) Field of Classification Search

CPC ..... E02F 9/2253; E02F 3/961; E02F 9/166; E02F 9/2004; E02F 3/32; E02F 3/34

USPC ..... 701/50

See application file for complete search history.

(56) References Cited

U.S. PATENT DOCUMENTS

| | | | | |
|---|---|---|---|---|
| 5,244,066 | A | 9/1993 | Mackoway et al. | |
| 6,851,495 | B2 | 2/2005 | Sprinkle et al. | |
| 2006/0021770 | A1 * | 2/2006 | Bachstein | E02F 9/2004 172/787 |
| 2015/0176249 | A1 | 6/2015 | McKee et al. | |

FOREIGN PATENT DOCUMENTS

| | | | |
|---|---|---|---|
| JP | 7502315 | A | 3/1995 |
| JP | 200071801 | A | 3/2000 |
| JP | 200856022 | A | 3/2008 |
| WO | 9409216 | A1 | 4/1994 |

* cited by examiner

*Primary Examiner* — Marthe Y Marc-Coleman
(74) *Attorney, Agent, or Firm* — The Webb Law Firm

(57) ABSTRACT

Disclosed is a work vehicle adapted to mount a front work implement operated under a forward facing posture and a rear work implement operated under a reverse facing posture. A forward/reverse operational unit includes a first operational tool operable by one hand of a driver under the reverse facing posture and a second operational tool operable by the one hand engaged in operation of the first operational tool. A traveling control unit includes a signal inputting section configured to input a first operational signal outputted from the one-hand control type forward/reverse operational unit in response to an operation on the first operational tool and a second operational signal outputted from the one-hand control type forward/reverse operational unit in response to an operation on the second operational tool, and a signal evaluating section configured to output a traveling command for causing a vehicle body to travel forwardly or reversely, based on the first operational signal and the second operational signal.

9 Claims, 5 Drawing Sheets

WORK VEHICLE

CROSS-REFERENCE TO RELATED APPLICATION

This application claims priority to Japanese Patent Application No. 2015-142179 filed Jul. 16, 2015, the disclosure of which is hereby incorporated in its entirety by reference.

BACKGROUND OF THE INVENTION

1. Field of the Invention

The present invention is directed to a work vehicle adapted to mount a front work implement operated under a forward facing posture and a rear work implement operated under a reverse facing posture.

2. Description of the Related Art

U.S. Pat. No. 6,851,495 B2 discloses a work vehicle operated by a driver seated under a forward facing posture. This work vehicle includes a direction switch for selecting a forward traveling and a reverse traveling; and a lever operational tool for adjusting a creeping speed. At a time of a work using a backhoe mounted at a vehicle body rear portion, a driver can use the direction switch and the lever operational tool to cause the vehicle body to travel forwardly or reversely at a desired speed. The direction switch is a a seesaw type momentary switch, and its selected operational position is transmitted to a control device. An operational position of the lever operational tool is detected by a potentiometer and transmitted to the control device. The driver will operate the direction switch to an operational position corresponding to a desired traveling direction, and also will operate the lever operational tool to a desired speed position. Then, the control device causes the vehicle body to travel in the direction (forward or reverse) based on the direction switch at the speed based on the operational position of the lever operational tool.

JP2008-056022A discloses a tractor in which a driver seated under a reverse facing posture can cause it to travel either forwardly or reversely, by operating a main switch and a sub switch constituting a shuttle switch at one time. The main switch includes a forward switch and a reverse switch that are disposed in close vicinity of each other. When it is desired to cause the vehicle body to travel forwardly or reversely with the driver being seated under the reversely facing posture, the driver will operate one of the forward and reverse switches and the sub switch simultaneously.

Forward/reverse traveling operations under the reverse facing posture are "special" operations in comparison with forward/reverse traveling operations under the forward facing posture, so it is desired that these forward/reverse traveling operations under the reverse facing posture should be simple operations. Further, a control scheme reflecting a driver's intension distinctly will also be desirable. However, with the above-described conventional state of art, there are provided two switches for the forward/reverse traveling operations under the reverse facing posture, and these switches are provided independently of each other and spaced apart from each other. Thus, for effecting forward or reverse operations under the reverse facing posture, independent operations corresponding respectively to the two switches are required for the driver. Moreover, respecting a time-sequence operation procedure for the plurality of switches, explicit disclosure relating thereto found in JP2008-056022A only discloses that the plurality of switches are operated simultaneously.

In view of the above-noted state of art, there is a need for a work vehicle that allows forward/reverse operations under the reverse facing posture to be effected in a more distinct manner, that is, through a time-sequence operational procedure with the driver's distinct awareness thereof and also in a more simple manner.

SUMMARY OF THE INVENTION

According to one aspect of the disclosure, a work vehicle is provided as under.

A work vehicle adapted to mount a front work implement operated under a forward facing posture and a rear work implement operated under a reverse facing posture, the work vehicle comprising:

- a one-hand control type forward/reverse operational unit including:
  - a first operational tool operable by one hand of a driver under the reverse facing posture; and
  - a second operational tool operable by the one hand engaged in operation of the first operational tool; and
- a traveling control unit including:
  - a signal inputting section configured to input a first operational signal outputted from the one-hand control type forward/reverse operational unit in response to an operation on the first operational tool, and a second operational signal outputted from the one-hand control type forward/reverse operational unit in response to an operation on the second operational tool; and
  - a signal evaluating section configured to output a traveling command for causing a vehicle body of the work vehicle to travel forwardly or reversely, based on the first operational signal and the second operational signal.

With the above-described arrangement, when a driver carries out a forward/reverse operation, the driver can easily carry out this operation with using his/her one hand only.

According to another aspect of the disclosure, the signal evaluating section is configured to output the traveling command for causing the vehicle body to travel forwardly or reversely, based on an input of the second operational signal under an inputting state of inputting the first operational signal. With this, when the driver is to effect a forward/reverse operation of the vehicle body under the driver's rear facing posture, the driver can effect this forward/reverse operation by operating the second operational tool under a state of the first operational signal based on an operation on the first operational tool being inputted to the traveling control unit. Namely, for forward or reverse traveling of the vehicle body, an operation on the first operational tool needs to be effected prior to an operation on the second operational tool. In this way, by providing time-sequential conditions to the operations on the first operational tool and the second operational tool, it becomes possible to realize a forward/reverse control scheme that allows clear recognition or awareness of the intension of the forward/reverse operation of the driver under the reverse facing posture. Such control scheme will contribute to prevention of unexpected vehicle body travel by an erroneous operation.

According to still another aspect of the disclosure, the first operational tool comprises a push button that is operated by a finger of the driver; and the second operational tool comprises a pivot lever that is operable by a hand of the driver engaged in operation on the first operational tool. With this arrangement, it becomes possible to cause the vehicle body to travel forwardly or reversely by an easy and distinct one-hand operation of the driver with pivotally operating the pivot lever by the other fingers than the finger used in pushing the first operational tool.

DESCRIPTION OF THE PREFERRED EMBODIMENTS

Figure 1:
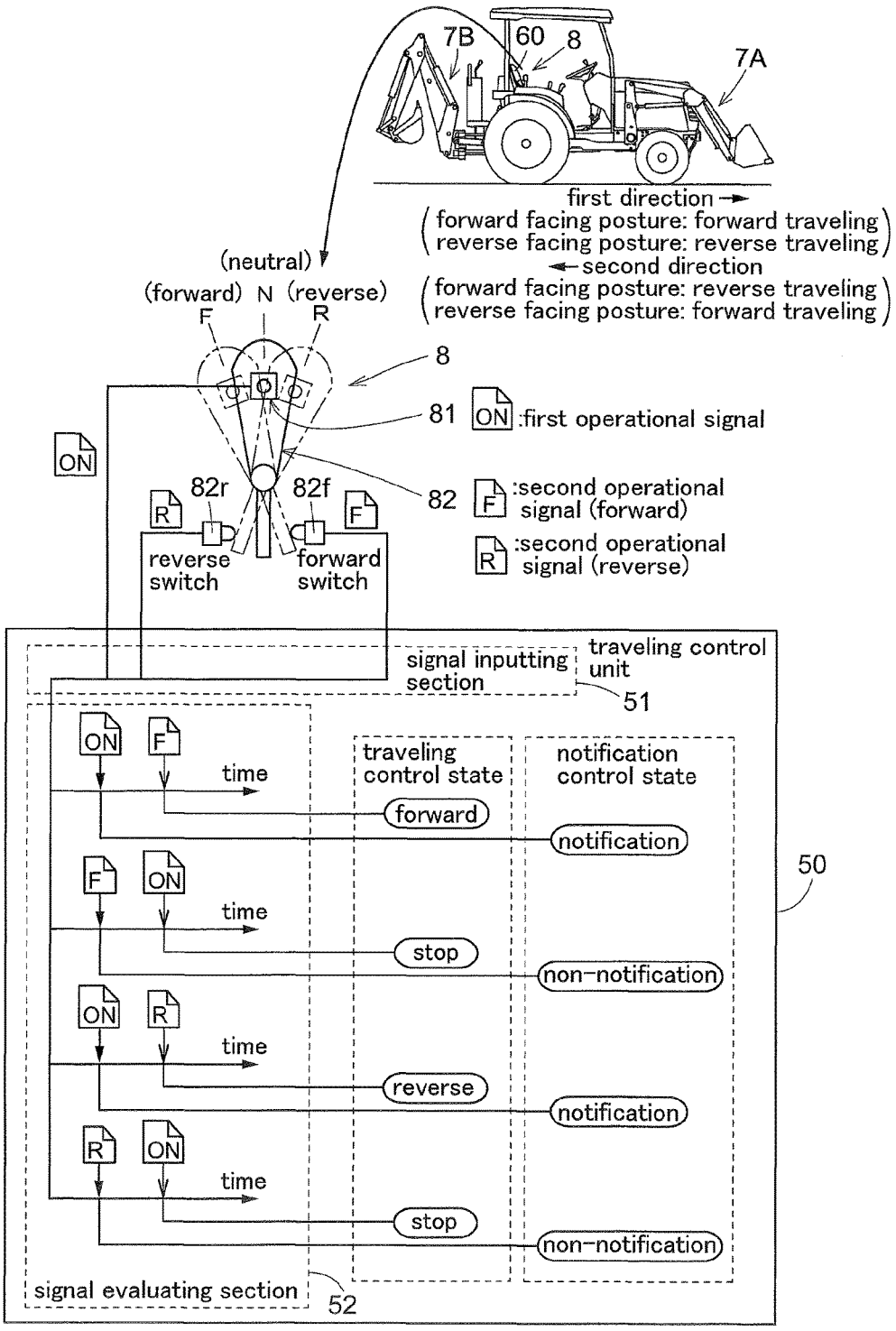
FIG. 1 is a schematic view illustrating a basic principle relating to a forward/reverse operation of a vehicle body under a reverse facing posture.

Prior to description of embodiments of a work vehicle relating to the present invention, with reference to FIG. 1, there will be illustrated a forward/reverse operation under a reverse facing posture and a basic principle of control thereof which characterizes the present invention.

A work vehicle can mount a front implement 7A at a vehicle body front portion and a rear implement 7B at a vehicle body rear portion. In FIG. 1, both of these implements are mounted. At a center portion of the vehicle body, a driver's seat 60 is provided. The front implement 7A is operated by a driver under the forward facing posture and the rear implement 7B is operated by the driver under the reverse facing posture. For operating the rear implement 7B, a one-hand control type forward/reverse operational unit 8 is provided. This one-hand control type forward/reverse operational unit 8 includes a first operational tool 81 operable by a hand of a driver under the reverse facing posture and a second operational tool 82 operable by the same hand of the driver engaged in operation of the first operational tool 81.

In the example shown in FIG. 1, the first operational tool 81 is operated by a thumb (a "finger") of a hand (e.g. left hand) and the second operational tool 82 is operated by being gripped by the fingers including the thumb of the same hand (e.g. left hand) or the other fingers than the thumb (the finger) of the same. The first operational tool 81, when operated, outputs a first operational signal (an ON signal in the case of FIG. 1) and the second operational tool 82 outputs two different signals in response to two different operations. In the case of the example shown in FIG. 1, in response to an operation in one direction on the second operational tool 82, a second operational signal meaning forward traveling is outputted; and in response to an operation in the other direction, a second operational signal meaning reverse traveling is outputted. In the following discussion, when it is necessary to discriminate between the two meanings of the second operational signal, the second operational signal meaning forward traveling will be referred to as the "forward operational signal", and the second operational signal meaning reverse traveling will be referred to as the "reverse operational signal", respectively.

The first operational signal outputted from the first operational tool 81 and the second operational signal outputted from the second operational tool 82 are inputted to a signal input section 51 of a traveling control unit 50 and evaluated by a signal evaluating section 52. This signal evaluating section 52 has a function of outputting a traveling command for causing the vehicle body to travel forwardly or reversely based on the first operational signal and the second operational signal.

Incidentally, in this detailed disclosure, in the "forward" traveling and "reverse" traveling under the forward facing posture, the work vehicle moves in directions opposite to the "forward" traveling and "reverse" traveling under the reverse facing posture. In particular, as shown in FIG. 1, in this detailed disclosure, the area where the front implement 7A is mounted is the vehicle body forward area and the area where the rear implement 7B is mounted is the vehicle body reverse area. The forward facing direction is defined as a "first direction" and the reverse facing direction is defined as a "second direction", respectively. Therefore, the "forward" at the time of operation under the driver's forward facing posture means traveling in the first direction, and the "reverse" at the time of operation under the driver's forward facing posture means traveling in the second direction, respectively. Conversely, the "forward" at the time of operation under the driver's reverse facing posture means traveling in the second direction, and the "reverse" at the time of operation under the driver's reverse facing posture means traveling in the first direction, respectively.

In order to output a traveling command for forward or reverse traveling, the signal evaluating section 52 requires, as "prerequisites" therefor, input of the first operational signal (ON signal) indicating the first operational tool 81 being operated, and input of the forward operational signal or reverse operational signal. Namely, for realizing forward traveling or reverse traveling of the vehicle body, the driver needs to operate the first operational tool 81 and the second operational tool 82 with using his/her one hand.

In order to make distinct the intension of forward or reverse traveling of the vehicle body by the driver under the reverse facing posture, it is preferred that input timings (chronological operations) of the first operational signal and the second operational signal be used as another prerequisites for outputting a traveling command for forward traveling or reverse traveling. For this reason, according to a preferred embodiment of the present invention, the signal evaluating section 52 is configured to output a traveling command for causing the vehicle body to travel forwardly or reversely based on input of the second operational signal (forward operational signal or reverse operational signal) under a state of the first operational signal (ON signal) being inputted. That is, in order to cause the vehicle body to travel forwardly or reversely, the driver needs to operate first the first operational tool 81 and then the second operational tool 82 in succession thereto.

As shown in FIG. 1, after an ON signal is inputted to the traveling control unit 50 in response to the first operational tool 81 being operated firstly, the second operational tool 82 is operated to the forward traveling side, whereby a forward operational signal is inputted to the traveling control unit 50, which then outputs a forward traveling command, thus causing the vehicle body to travel forwardly. As described above, as this situation concerns an operation under the reverse facing posture, this forward traveling is traveling in the second direction. In the course of the above, at the timing of input of the ON signal to the control unit 50, in order to make the driver distinctly aware of completion of traveling preparation of the vehicle body, it is preferred that information indicative of traveling preparation completion be notified to the driver through a notifying device such as a buzzer, a light, etc. Upon receipt of this traveling preparation completion notification, the driver will operate the second operational tool 82 to cause the vehicle body to travel forwardly. With this arrangement, unexpected or erroneous vehicle body traveling can be avoided. Conversely, if the first operational tool 81 is operated after the second operational tool 82 is operated to the forward traveling side first, the vehicle body will remain stopped even if the first operational tool 81 and the second operational tool 82 are both operated, and also no notification of traveling preparation completion will be made.

Similarly, when an ON signal is inputted to the traveling control unit 50 in response to the first operational tool 81 being operated firstly, and thereafter the second operational tool 82 is operated to the reverse traveling side so that a reverse operational signal is inputted to the traveling control unit 50, then a reverse traveling command is outputted, thereby to cause the vehicle body to travel reversely (i.e. travel in the first direction). In this case too, it is preferred that information indicative of traveling preparation completion be notified to the driver through a notifying device such as a buzzer, a light, etc.

Although shown only schematically in FIG. 1, according to one preferred embodiment of the forward/reverse operational unit 8 operated by one hand, the first operational tool 81 comprises a push button (this push button too will be denoted with the numeral 81 hereinafter) that is operated by a finger (or a thumb) of the driver and the second operational tool 82 comprises a pivot lever (this pivot lever too will be denoted with the numeral 82 hereinafter) that can be operated by the same hand of the driver engaged in operation on the first operational tool 81. More particularly, the push button 81 (first operational tool 81) operable by a thumb or an index finger or the like (i.e. "a finger") can be provided in a grip portion of the pivot lever 82 (second operational tool 82). With this arrangement, the vehicle body can be caused to travel forwardly or reversely by the driver's pushing the push button 81 when gripping the grip portion and then pivoting the pivot lever in the forward direction or reverse direction.

Such vehicle traveling effected under the reverse facing posture is not a "normal" vehicle traveling. So, this traveling is effected generally at a low speed. And, at such low speed, speed change is not so important. From this point view, if the reverse-facing forward traveling speed and the reverse-facing reverse traveling speed realized by the operation on the one-hand control type forward/reverse operational unit 8 are set respectively as a speed which is equal to or lower than a half of the maximum speed that can be realized by this work vehicle and which also is a constant speed, this will be advantageous since this arrangement involves simplification of the control arrangement also. Furthermore, in the case of reverse traveling which is the reverse traveling under the driver's reverse facing posture (vehicle body movement in the first direction), the traveling course visibility is poorer than the forward traveling which is the forward traveling under the driver's reverse facing posture (vehicle movement in the second direction). For this reason, it is advantageous to set the reverse facing reverse traveling speed lower than the reverse facing forward traveling speed. More particularly, it is proposed that the reverse facing forward traveling speed realized by an operation on the one-hand control type forward/reverse operational unit be set as a constant speed which is equal to or lower than a half of a forward maximum speed under the forward facing posture and the reverse facing reverse traveling speed realized by an operation on the one-hand control type forward/reverse operational unit be set as a constant speed which is equal to or lower than a half of a reverse maximum speed under the forward facing posture.

For the sake of greater comfort for the driver's operation under the reverse facing posture, it will be convenient if the driver's seat adapted for the forward facing posture operation is reversible between forward and reverse orientations, so as to allow both the forward facing posture and the reverse facing posture to be realized by the driver seated in the same driver's seat. Moreover, in general, for the forward/reverse operation of the vehicle body under the forward facing posture, a foot pedal is employed. But, it is also important to avoid occurrence of unexpected vehicle body traveling by an erroneous stepping-on operation on the foot pedal by someone other than the driver himself/herself. For this reason, according to one preferred embodiment, there is provided a foot pedal type forward/reverse operational unit (provided generally in the form of a speed changer pedal) operable under the forward facing posture; and the driver's seat is selectable between a forward facing position suitable for an operation of the foot pedal type forward/reverse operational unit and a reverse facing position suitable for an operation of the one-hand control type forward/reverse operational unit; and the travel control unit is configured to disable an operation on the foot pedal type forward/reverse operational unit when the driver's seat is set to the reverse facing position. In view of the current situation that the vehicle body traveling under the reverse facing posture is limited to traveling for a relatively short distance at a relatively low speed, it may also be a preferred option to configure such that when the driver's seat is set to the forward facing position, operations of both the foot pedal type forward/reverse operational unit and the one-hand control type forward/reverse operational unit are enabled, thus improving general versatility thereof.

Figure 2:
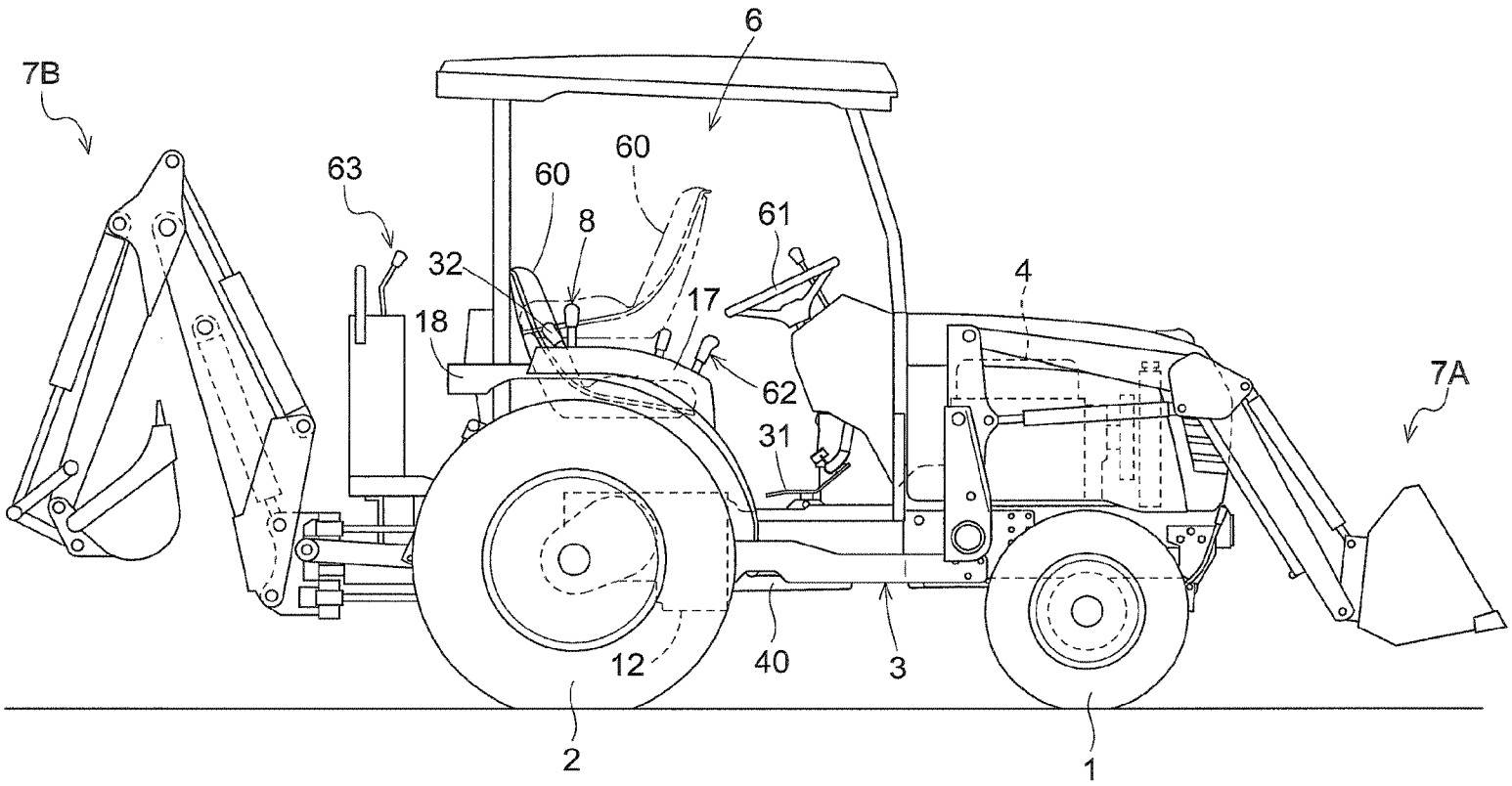
FIG. 2 is a side view showing one embodiment of the present invention showing a tractor as an example of a work vehicle.
Figure 3:
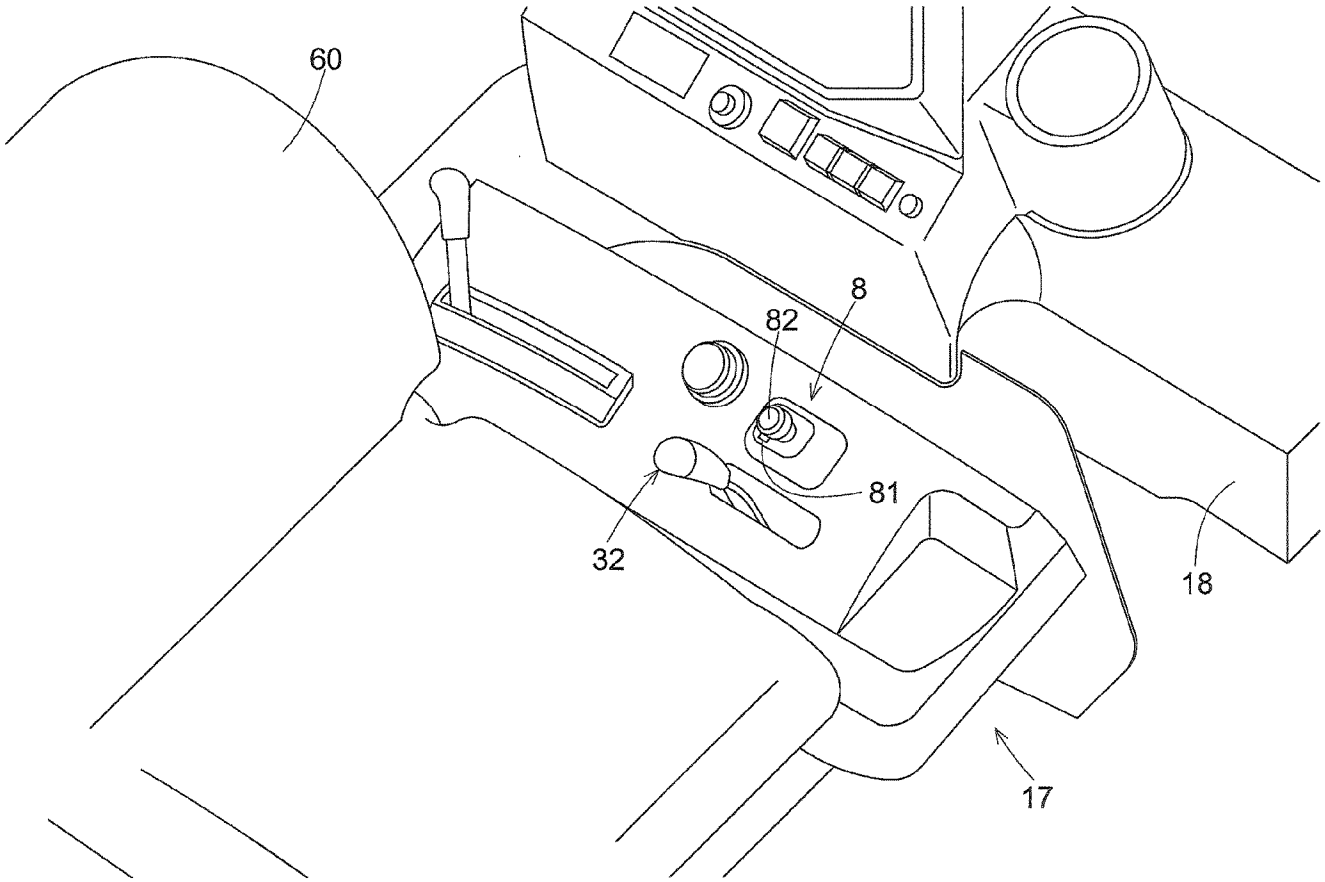
FIG. 3 is a perspective view showing a driver's seat and its surrounding at a time of reverse facing operation.

With reference to FIG. 2 et seq. next, one specific embodiment of the work vehicle relating to the present invention will be described. FIG. 2 is a side view of a tractor of "TLB" (Tractor-Loader-Backhoe) type as an example of the work vehicle. (In the following discussion, the front implement 7A will be referred to as a bucket loader 7A, and the rear implement 7B will be referred to as a backhoe 7B, respectively.) FIG. 3 is a perspective view showing a portion of a driver's section of the tractor. This tractor includes a vehicle body 3 supported on a ground surface via a pair of left and right steerable and drivable front wheels 1 and a pair of left and right drivable rear wheels 2. At a front portion of the vehicle body 3, an engine 4 is mounted; and a driver's section 6 is mounted at a rear portion of the vehicle body 3. Further, at a front portion of the vehicle body 3, the bucket loader 7A is mounted; and at a rear portion of the vehicle body 3, the backhoe 7B is mounted.

The vehicle body 3 further mounts a stepless speed changer device 40 connected to a rear portion of the engine 4, and a transmission 12 for transmitting an output of the stepless speed changer device 40 to the rear wheels 2 and optionally also to the front wheels 1 when needed. The stepless speed changer device 40 can be a hydrostatic stepless speed changer device (called "HST" for short) or a hydraulic mechanical stepless speed changer (called "HMT" for short). In this particular embodiment, as an HST is employed, so the stepless speed changer device 40 will referred to as the HST 40 hereinafter.

As shown in FIG. 2, the driver's seat 60 is switchable (reversible) between a forward facing position suitable for a driver's forward facing posture (the forward traveling direction of the vehicle body 3) and a reverse facing position suitable for a driver's reverse facing posture (the reverse traveling direction of the vehicle body 3) (denoted by two-dot chain line in FIG. 2). Forwardly of the driver seated at the driver's seat 60 under the forward facing posture, a steering wheel 61 is disposed and at the foot thereof, a speed changer pedal 31 for effecting a speed changing operation by the HST 40 is disposed. The speed changer pedal 31 used in this embodiment is an embodiment of a foot pedal type forward/reverse operational unit and configured to provide forward acceleration when stepped on forwardly from its neutral position and to provide reverse acceleration when stepped on reversely from its neutral position.

In an operational panel 17 disposed laterally of the driver seated at the driver's seat 60 under the reverse facing posture, there is disposed a one-hand control type forward/reverse operational unit 8. FIG. 3 shows the driver's seat 60 switched to the reverse facing position. As shown, the operational panel 17 is disposed between the driver's seat 60 and a rear wheel fender 18. The one-hand control type forward/reverse operational unit 8 includes the first operational tool 81 and the second operational tool 82. In this embodiment, the second operational tool 82 is provided as the pivot lever 82 which is pivotable in the front/rear direction. The first operational tool 81 is provided as a button (push) switch attached to a lateral face of a grip of the pivot lever 82. The operational panel 17 includes an accelerator lever 32, etc., in addition to the one-hand control type forward/reverse operational unit 8.

Laterally of the driver's seat 60 at its forward facing position, there is disposed a bucket loader operational tool 62 for operating the bucket loader 7A under the forward facing posture. Rearwardly of the driver's seat 60 at its reverse facing position, there is disposed a backhoe operational tool 63 for operating the backhoe 7B under the verse facing posture.

Figure 4:
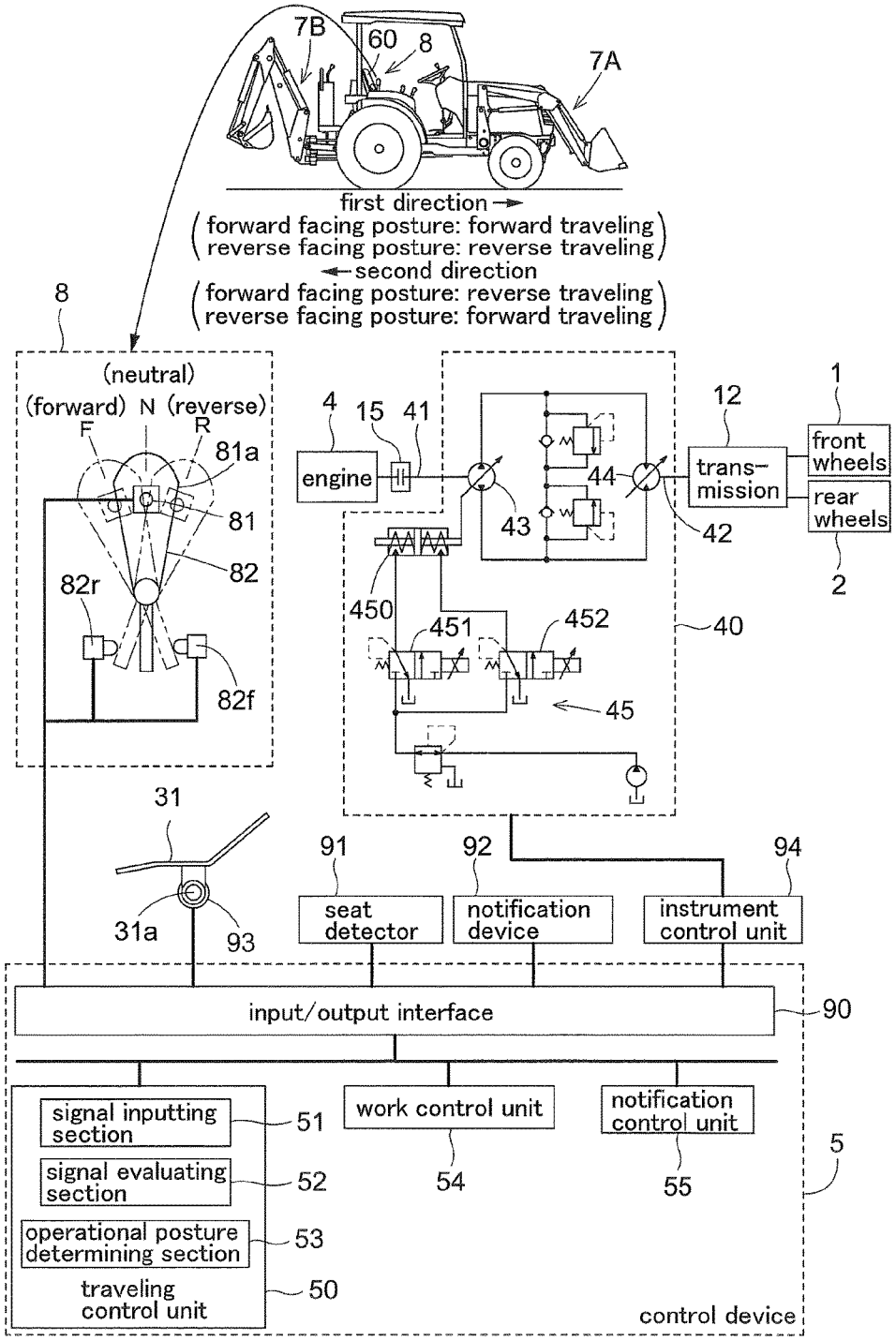
FIG. 4 is a functional block diagram showing an implement operation control line.

FIG. 4 shows a functional block diagram showing a speed changing control line using the HST 40 in this tractor. To the HST 40, power of the engine 4 is transmitted via a main clutch 15. The HST 40 includes an input shaft 41, an output shaft 42, an axial plunger, variable displacement type hydraulic pump 43 using the input shaft 41 as a pump shaft, and an axial plunger type hydraulic motor 44 using the output shaft 42 as a motor shaft. The hydraulic motor 44 is driven by pressure oil fed from the variable displacement hydraulic pump 43. Further, the HST 40 includes a speed changing control unit 45. This speed changing control unit 45 includes a servo cylinder type speed changing cylinder 40 operably coupled to a swash plate operational shaft of the variable displacement hydraulic pump 43, and a first direction proportional control valve 451 and a second direction proportional control valve 452 which are connected to this speed changing cylinder 450.

The first direction proportional control valve 451 and the second direction proportional control valve 452 are operated based on control signals transmitted from a control device 5 via an instrument control unit 94. When the speed changing cylinder 450 is displaced by the first direction proportional control valve 451 and the second direction proportional control valve 452, a swash plate angle of the variable displacement hydraulic pump 43 is varied. In association with this change in the swash plate angle, the engine power inputted to the input shaft 41 is speed-changed steplessly as a forward driving force or a reverse driving force and outputted as such via the output shaft 42. With this, the front wheels 1 and the rear wheels 2 are driven, so that the vehicle body 3 is moved in the first direction (forward traveling in the case of the forward facing posture operation, or reverse traveling in the case of the reverse facing posture operation) or moved in the second direction (reverse traveling in the case of the forward facing posture operation or forward traveling in the case of the reverse facing posture operation).

As shown in FIG. 4, the push button 81 of the one-hand control type forward/reverse operational unit 8 is connected to the control device 5, so that an operational signal (first operational signal: ON signal or OFF signal) of the push button 81 is transmitted to this control device 5. Further, to the control device 5, there are connected also a forward switch 82*f* for detecting operation on the pivot lever 82 to its forward position, and a reverse switch 82*r* for detecting operation on the pivot lever 82 to its reverse position. In operation, when the pivot lever 82 is pivoted to the forward position (denoted with "F" in FIG. 4) and the forward switch 82*f* is turned ON, a forward operational signal acting as a second operational signal by the pivot lever 82 is transmitted to the control device 5. Similarly, when the pivot lever 82 is pivoted to the reverse position (denoted with "R" in FIG. 4) and the reverse switch 82*r* is turned ON, a reverse operational signal acting as a second operational signal by the pivot lever 82 is transmitted to the control device 5. Further, to a rotational shaft 31 a of the speed changer pedal 31, there is coupled a rotation detector 93 for detecting a stepped-on amount of the speed changer pedal 31, i.e. a rotational displacement of the rotational shaft 31 a. and this stepped-on amount of the speed changer pedal 31 is transmitted to the control device 5.

The control device 5 includes an input/output interface 90, a traveling control unit 50, a work control unit 54, a notification control unit 55, and so on. The input/output interface 90 inputs signals from the push button 81 of the one-hand control type forward/reverse operational unit 8, the forward switch 82*f*, the reverse switch 82*r*, the rotation detector 93 of the speed changer pedal 31, etc. Further, the interface 90 inputs also signal from a seat detector 91 for detecting the forward facing position or the reverse facing position of the driver's seat 60.

Moreover, to this input/output interface 90, there are connected a notification device 92 constituted of a buzzer, a lamp or the like receiving a control signal from the control device 5, and the instrument control unit 94 that provides a control signal to the first direction proportional control valve 451 and the second direction proportional control valve 452 described hereinbefore.

The traveling control unit 50 has a function of controlling forward traveling and reverse traveling of the vehicle body 3 and implements the basic principle as described above with reference to FIG. 1. Therefore, the traveling control unit 50 includes a signal inputting section 51, a signal evaluating section 52 and an operation posture determining section 53. The operation posture determining section 53 determines whether the driver's seat 60 is located at the forward facing position or the reverse facing position, based on a detection signal from the seat detector 91 inputted to the signal inputting section 51. If it is determined that the seat 60 is located at the reverse facing position, then, it is judged that the driver is currently effecting an operation under the reverse facing posture, so that the signal evaluating section 52 for evaluating an operational signal relating to traveling control will ignore the operational signal by the speed changer pedal 31 and will evaluate only the operational signal by the one-hand control type forward/reverse operational unit 8.

The work control unit 54 has such functions as a function of providing a control signal to the bucket loader 7A based on an operational signal generated by an operation on the bucket loader operational tool 62 (see FIG. 2), a function of providing a control signal to the backhoe 7B based on an operational signal generated by an operation on the backhoe operational tool 63, and so on. The notification control unit 55 generates a notification signal to give the driver notification information via the notification device 92. For instance, if the driver pushes the push button 81 when it is determined that the driver's seat 60 is located at its forward facing position, thus generating an ON signal to be inputted to the signal inputting section 51, it can be reasonably anticipated that the vehicle body 3 will then be caused to travel forwardly or reversely, so that the notification control unit 55 will activate the buzzer as an example of the notification device 92.

Figure 5:
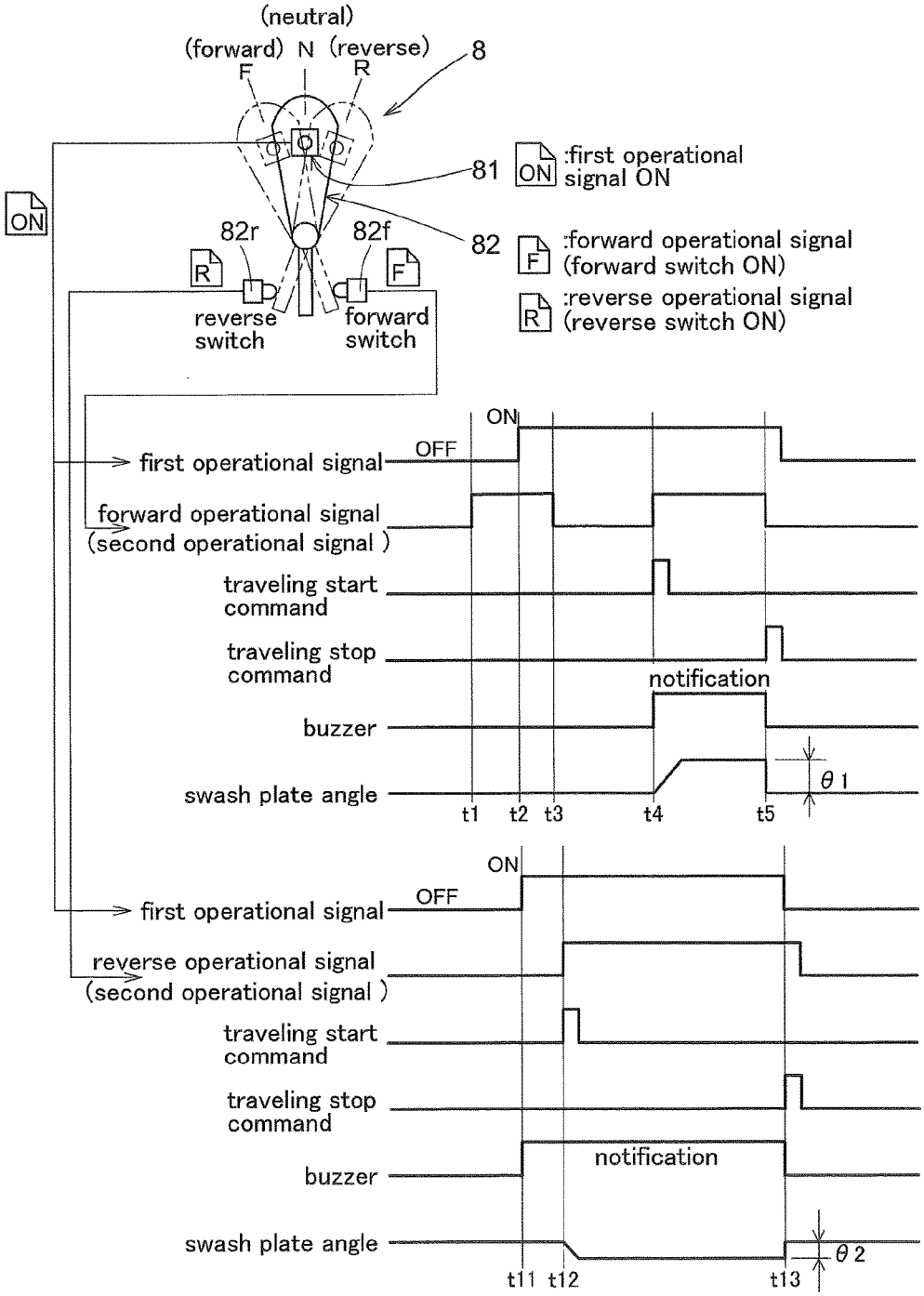
FIG. 5 is a timing chart showing an example of forward and reverse traveling at the time of reverse facing posture work.

Next, with reference to the timing chart shown in FIG. 5, there will be described an example of control operation by the traveling control unit 50 based on an operation on the one-hand control type forward/reverse operational unit 8.

An example of forward operation will be described by way of lapse of time from a timing: t1 to a timing: t5. Here, firstly, as the pivot lever 82 is pivotally operated to the forward position (F), the forward operational signal acting as a second operational signal is turned ON (timing: t1). Thereafter, as the push button 81 is pushed, the first operational signal is turned ON (timing: t2). The signal evaluating section 52 is configured to ignore a pivotal operation on the pivot lever 82 unless this pivotal operation on the pivot lever 82 is preceded by a push operation on the push lever 81, so that at this stage, the tractor remains stationary. Then, if the pivot lever 82 is temporarily returned to the neutral position (N), the forward operational signal is turned OFF (timing: t3). Thereafter, when the pivot lever 82 is again pivotally operated to the forward position (F), the forward operational signal is turned ON (timing: t4). As the current ON state of the forward operational signal at this timing: t4 is preceded by the ON state of the first operational signal by a pushing operation on the push button 81, the notification control unit 55 will activate the buzzer acting as the notification device 92 and also the signal evaluating section 52 outputs a traveling start command (forward traveling) (timing: t4). In response to this output of traveling start command (forward traveling), a control signal is outputted to the speed changing control unit 45 and the swash plate angle of the HST 40 is displaced from the neutral position (N) to a forward side predetermined angle: θ1. As this forward side predetermined angle: θ1 is as an angle which is much smaller than a swash plate angle corresponding to the maximum speed, the tractor will make creeping forward traveling. When the tractor has advanced to reach the predetermined position, the driver will remove the finger from the push button 81 to turn this button 81 OFF or remove the fingers from the pivot lever 82 to allow this lever 82 to return to the neutral position (N), the signal evaluating section 52 outputs a traveling stop command (timing: t5). In response to this output of traveling stop command, the buzzer stops sounding and the swash plate angle of the HST 40 is returned to the neutral position (N), whereby the tractor will be stopped.

Incidentally, in case the ON state of the first operational signal by a pushing operation on the push button 81 precedes the ON state of the forward operational signal from the beginning, the signal evaluating section 52 will output the traveling start command (forward traveling) upon turning of the forward operational signal to ON state.

Next, an example of reverse operation will be described by way of lapse of time from a timing: t11 to a timing: t13. In this example, as the push button 81 has been pushed prior to a pivotal operation on the pivot lever 82 thus turning the first operational signal ON (timing: t11), at this timing, the buzzer is activated. In succession, as the pivot lever 82 is pivotally operated to the reverse position (R), the reverse operational signal acting as a second operational signal is turned ON, so that the signal evaluating section 52 outputs a traveling start command (reverse traveling) (timing: t12). In response to this output of traveling start command (reverse traveling), a control signal is outputted to the speed changing control unit 45 and the swash plate angle of the HST 40 is displaced from the neutral position (N) to a reverse side predetermined angle: θ2. With this, the tractor will make creeping reverse traveling.

Incidentally, in this embodiment, the predetermined angle: θ2 to the reverse side is set smaller than the predetermined angle:θ1 to the forward side, so that the reverse traveling is made at a speed lower than the forward traveling. When the driver removes the finger from the push button 81 to turn this button 81 OFF or remove the fingers from the pivot lever 82 to allow this lever 82 to return to the neutral position (N), the signal evaluating section 52 outputs a traveling stop command (timing: t13). In response to this output of traveling stop command, the buzzer stops sounding and the swash plate angle of the HST 40 is returned to the neutral position (N), whereby the tractor will be stopped.

[Other Embodiments]

(1) In the foregoing embodiment, the first operational tool 81 constituting the one-hand control type forward/reverse operational unit 8 operated by one hand is provided as a push button, and the second operational tool 82 is provided as a pivot lever, and also the first operational tool 81 is disposed in the lateral face of the grip of the second operational tool 82. Instead of this, both the first operational tool 81 and the second operational tool 82 can be provided each as a pivot lever operable by one hand. Further alternatively, the first operational tool 81 and the second operational tool 82 can be combined into a single three-direction operational tool configured to output the first operational signal in response to an operation in a first direction, the forward operational signal in response to an operation in a second direction and the reverse operational signal in response to an operation in a third direction, respectively. Still further alternatively, the second operational tool can be comprised of a forward button and a reverse button, so that the three push buttons together constitute the one-hand control type forward/reverse operational unit 8.

(2) In the foregoing embodiment, forward traveling and reverse traveling provided by the one-hand control type forward operational unit 8 are effected each at its constant speed which is set in advance. Instead, the reverse switch and the forward switch can be comprised each of a detector capable of detecting a variable operational amount, such as a potentiometer, so that speed adjustment may be realized also in the forward traveling and the reverse traveling by the one-hand control type forward/reverse operational unit 8.

(3) An arrangement can be provided such that, in case an operation by the second operational tool 82 is disabled due to e.g. connection failure of the reverse switch and/or the forward switch, forward traveling can be provided by the first operational tool 81 alone.

(4) The work vehicle according to the present invention is applicable to a multi-purpose (utility) work vehicle, in particular, a construction or civil engineering work vehicle, other than the tractor.

What is claimed is:

1. A work vehicle adapted to mount a front work implement operated under a forward facing posture and a rear work implement operated under a reverse facing posture, the work vehicle comprising:

a one-hand control type forward/reverse operational unit including:

a first operational tool operable by one hand of a driver under the reverse facing posture; and a second operational tool operable by the one hand engaged in operation of the first operational tool; and a control device comprising an input/output interface operatively connected to the first operational tool and the second operational tool, the control device configured to:

input by the input/output interface a first operational signal outputted from the one-hand control type forward/reverse operational unit in response to an operation on the first operational tool, and a second operational signal outputted from the one-hand control type forward/reverse operational unit in response to an operation on the second operational tool; and output by the input/output interface a traveling command for causing a vehicle body of the work vehicle to travel forwardly or reversely, based on the first operational signal and the second operational signal.

2. The work vehicle according to claim 1, wherein the control device is configured to output by the input/output interface the traveling command for causing the vehicle body to travel forwardly or reversely, based on an input by the input/output interface of the second operational signal under an inputting state of inputting the first operational signal.

3. The work vehicle according to claim 1, wherein:

the first operational tool comprises a push button that is operated by a finger of the driver; and the second operational tool comprises a pivot lever that is operable by a hand of the driver engaged in operation on the first operational tool.

4. The work vehicle according to claim 1, wherein:

each of a reverse-facing forward traveling speed and a reverse-facing reverse traveling speed is provided in response to an operation on the one-hand control type forward/reverse operational unit; and the reverse-facing forward traveling speed is set as a speed which is equal to or lower than a half of a forward maximum speed under the forward facing posture and which is constant, and the reverse-facing reverse traveling speed is set as a speed which is equal to or lower than a half of a reverse maximum speed under the forward facing posture and which is constant.

5. The work vehicle according to claim 4, wherein the reverse-facing reverse traveling speed is set lower than the reverse-facing forward traveling speed.

6. The work vehicle according to claim 1, further comprising:

a foot pedal type forward/reverse operational unit operable under the forward facing posture; and a driver's seat, the driver's seat being selectively oriented between a forward facing position suitable for an operation of the foot pedal type forward/reverse operational unit, and a reverse facing position suitable for an operation of the one-hand control type forward/reverse operational unit, wherein when the driver's seat is set to the reverse facing position, a signal is inputted to the control device by the input/output interface to disable an operation on the foot pedal type forward/reverse operational unit.

7. The work vehicle according to claim 6, wherein when the driver's seat is set to the forward facing position, a signal is inputed to the control device by the input/output interface to enable operations of both the foot pedal type forward/reverse operational unit and the one-hand control type forward/reverse operational.

8. The work vehicle according to claim 1, wherein notification information is outputted in case it is evaluated that forward or reverse traveling of the vehicle body is allowable, based on input states of the first operational signal and the second operational signal.

9. The work vehicle according to claim 1, wherein in case input of the second operational signal is preceded by input of the first operational signal, the control device does not output by the input/output interface the traveling command even when the second operational signal and the first operational signal are being inputted.

* * * * *